US007721574B2

(12) United States Patent
Castelli et al.

(10) Patent No.: US 7,721,574 B2
(45) Date of Patent: May 25, 2010

(54) YARN-RECOVERING DEVICE FOR TEXTILE MACHINES

(75) Inventors: Rosario Castelli, Gandino (IT); Pietro Zenoni, Leffe (IT); Luca Gotti, Albino (IT)

(73) Assignee: LG.L. Electronics S.p.A., Gandino (IT)

( * ) Notice: Subject to any disclaimer, the term of this patent is extended or adjusted under 35 U.S.C. 154(b) by 677 days.

(21) Appl. No.: 11/453,861

(22) Filed: Jun. 16, 2006

(65) Prior Publication Data

US 2007/0018027 A1 Jan. 25, 2007

(30) Foreign Application Priority Data

Jul. 7, 2005 (IT) ..... TO2005A0469

(51) Int. Cl.
*D04B 15/46* (2006.01)

(52) U.S. Cl. ..... 66/125 R

(58) Field of Classification Search ..... 66/125 R, 66/132 R, 136, 146, 175
See application file for complete search history.

(56) References Cited

U.S. PATENT DOCUMENTS 4,247,057 A * 1/1981 Jacobsson ..... 242/365.1
4,747,549 A * 5/1988 Balzarotti ..... 242/366.2
4,764,875 A * 8/1988 Carrotte et al. ..... 66/125 R
4,926,912 A * 5/1990 Zenoni ..... 139/452
5,931,023 A * 8/1999 Brach et al. ..... 66/136
6,079,656 A * 6/2000 Schmodde et al. ..... 242/365.7
6,105,398 A * 8/2000 Leins et al. ..... 66/132 R
6,170,301 B1 * 1/2001 Stoll et al. ..... 66/126 R

FOREIGN PATENT DOCUMENTS

GB 0884075 A * 12/1961

* cited by examiner

*Primary Examiner*—Danny Worrell
(74) *Attorney, Agent, or Firm*—Modiano & Associati; Albert Josif; Daniel J. O'Byrne

(57) ABSTRACT

A yarn recovering device for textile machines, arranged upstream of a textile machine for temporarily recovering a length of yarn previously fed to the machine, and for returning it subsequently. A motorized reel has a substantially axial inlet port and an outlet port on its lateral surface, with a passage for the yarn between the ports. The reel is operatable to rotate from a resting configuration, in which it is kept still, to an active, yarn-recovering configuration, in which it is driven in one direction for winding the yarn on itself and recovering it from the machine, to a subsequent active, yarn-unwinding configuration, in which it is driven in the opposite direction for unwinding the yarn from itself and returning it to the machine. A position sensor measures the position of the reel and sends a corresponding measured position signal to a position control loop which compares the measured position signal with a reference position signal corresponding to a desired position for the motorized reel, and drives the reel in such a way as to minimize the difference between the measured position and the desired position.

18 Claims, 3 Drawing Sheets

YARN-RECOVERING DEVICE FOR TEXTILE MACHINES

The present invention relates to a yarn-recovering device for textile machines, particularly sock-knitting machines and knitting machines in general.

BACKGROUND OF THE INVENTION

As is known, knitting machines draw the yarn either directly from a spool or through a yarn-feeding device which draws the yarn from the spool and feeds it to the machine under a regulated tension.

For certain particular machinings, such as the knitting of the heel in the sock-manufacturing processes, the yarn fed to the machine must be periodically recovered, and then returned more or less progressively. Since neither the traditional feeders nor the spools are capable of recovering the yarn previously fed, this function is performed by a dedicated yarn-recovering device located upstream of the machine.

To this purpose, devices are known which are provided with a pneumatically operated rocking arm having an eyelet mounted to its free end, through which the yarn passes. At rest, the arm is arranged with its eyelet aligned to the running direction of the yarn, between two stationary eyelets which are also passed through by the yarn. By rotating the arm, the yarn is deviated from its rectilinear path and a length of yarn is consequently recovered.

The above known devices provided with a rocking arm have the main drawback that their yarn-recovering capacity, i.e., the maximum length of yarn recoverable at each operation, is rather limited since strictly correlated to the length of the arm, which of course, for size reasons, cannot exceed predetermined values, typically in the range 300 to 400 mm.

Moreover, the operation of the arm can subject the yarn upstream of the device to considerable peaks of tension, which circumstance, as well known to the person skilled in the art, is undesirable because it may cause the yarn to brake and may affect the accuracy and the exactness of the feeding process.

SUMMARY OF THE INVENTION

Therefore, it is a main object of the present invention to provide a yarn-recovering device for textile machines which has a recovering capacity much higher than the known devices and which, in operation, does not subject the upstream yarn to harmful peaks of tension.

The above object and other advantages, which will better appear below, are achieved by a yarn-recovering device having the features recited in claim 1, while the dependent claims state other advantageous, though secondary, features of the invention.

BRIEF DESCRIPTION OF THE DRAWINGS

The invention will be now described in more detail with reference to a few preferred, non-exclusive embodiments, shown by way of non limiting example in the attached drawings, wherein.

DESCRIPTION OF THE PREFERRED EMBODIMENTS

Figure 1:
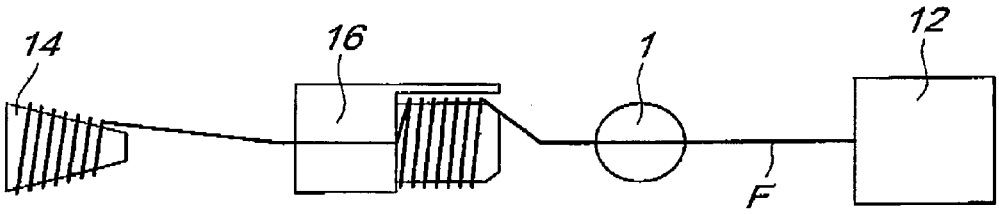
Fig. 1 PRIOR ART
FIG. 1 diagrammatically shows the positioning of a general yarn-recovering device with respect to a knitting machine.

With initial reference to FIG. 1, a general yarn-recovering device is intended to be arranged upstream of a general knitting machine 12 in order to intercept the yarn drawn by the machine either directly from a spool 14, or through a yarn feeder 16 which draws the yarn from spool 14 and feeds it to machine 12 under a regulated tension.

Yarn-recovering device 10 according to the invention comprises a reel 18 keyed to a driving shaft 20. of a motor 22 and arranged with its axis A sloping at a first angle a with respect to the direction of the incoming yarn indicated by arrow D, with its free end 18*a* facing the incoming yarn at an angle. A cylindrical, axial cavity 26 is formed at free end 18*a* of the reel. A passage 28 is formed between an inlet port 28*a* that is open to axial cavity 26 and an outlet port 28*b* that is open to lateral surface 18*b* of the reel. Passage 28 is rectilinear and is inclined at a second angle $\beta$ substantially equal to first angle $\alpha$ with respect to axis A of the reel. A ceramic, yarn-guide eyelet 30 provided with a beveled inner surface is applied to the rim of axial cavity 26. A pair of yarn-guide eyelets 32, 24 are respectively arranged upstream and downstream of reel 18 and are aligned to the outermost section of axial cavity 26.

Figure 2:
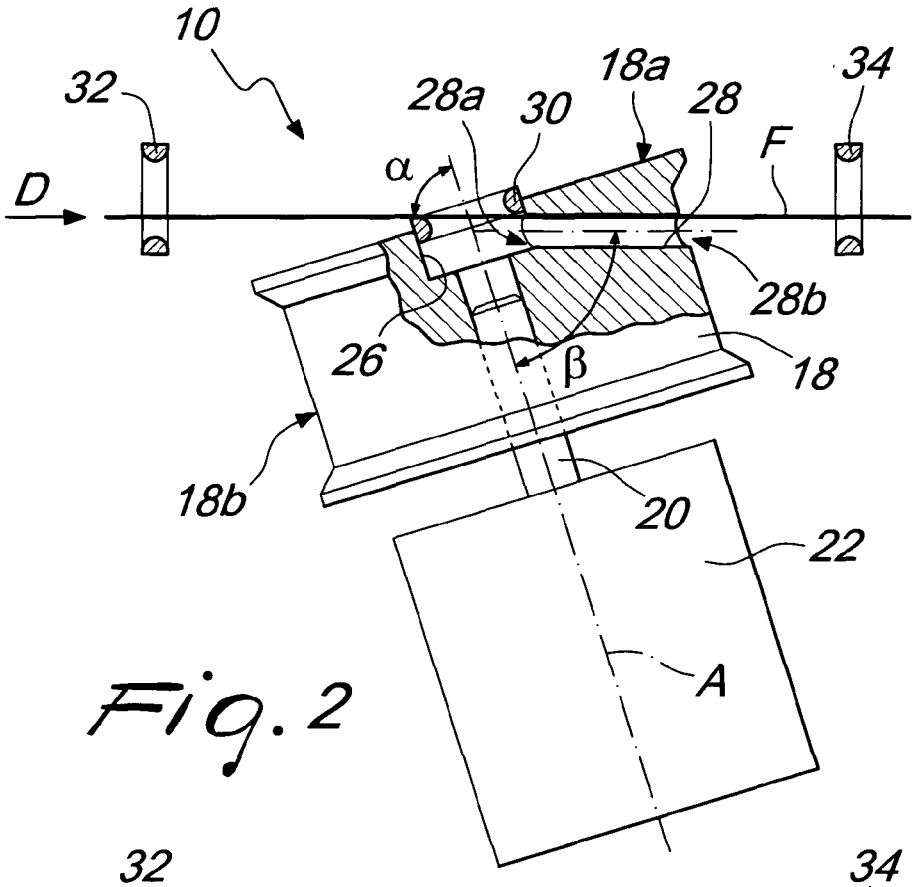
FIG. 2 is a side elevation view of a yarn-recovering device according to the invention, at rest.
Figure 3:
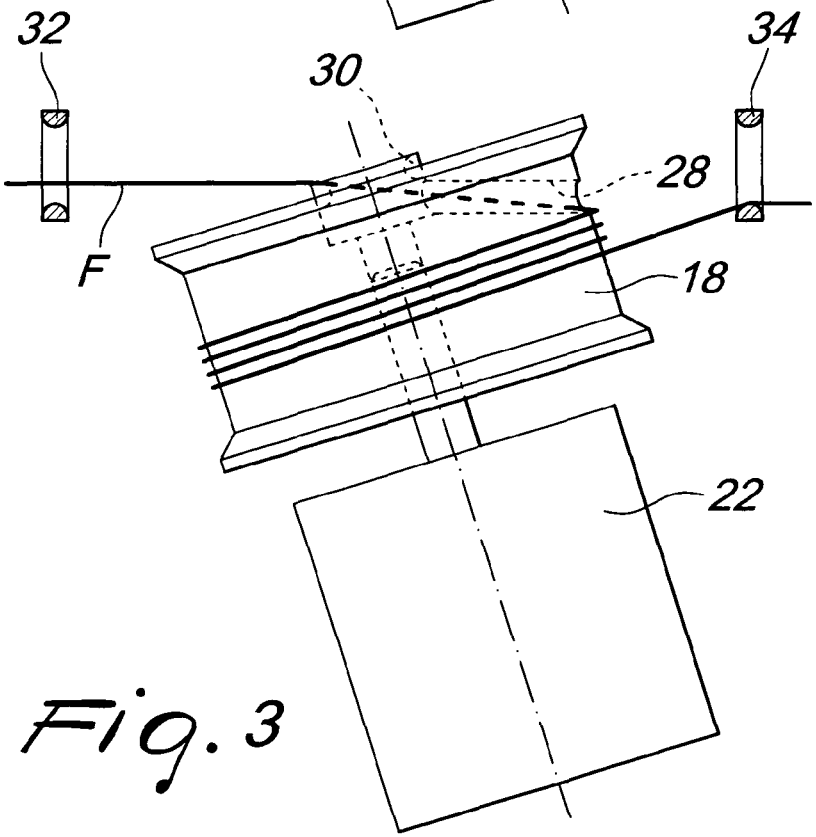
FIG. 3 is a view similar to FIG. 2 showing the device in operation.

In operation, yarn F fed to the downstream machine passes through upstream yarn-guide eyelet 32, axial cavity 26, passage 28 and downstream yarn-guide eyelet 34. At rest, reel 18 is motionless at the resting position of FIG. 2, with passage 28 aligned to eyelets 32, 34 without interfering with the yarn. When it is required to recover yarn from the downstream machine, motor 22 is operated in a first direction and, consequently, the yarn downstream of the reel is wound on reel 18 (FIG. 3), while the yarn upstream of the reel is not subjected to floatations because cavity 26 rotates about its axis. Yarn-guide eyelet 30 protects yarn F from wear due to friction against the edge of axial cavity 26. For returning the. yarn, reel 18 is rotated to the initial position in the opposite direction, with the skew opening aligned to the path of the yarn.

Figure 4:
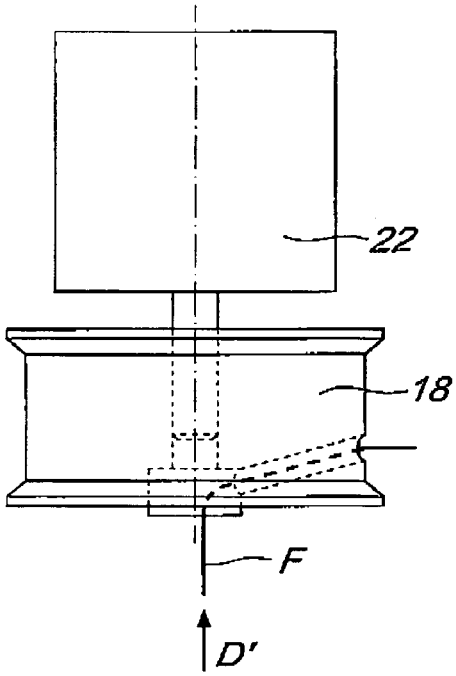
FIG. 4 is a side elevation view of a yarn-recovering device of FIG. 1 in an alternative configuration, at rest.
Figure 5:
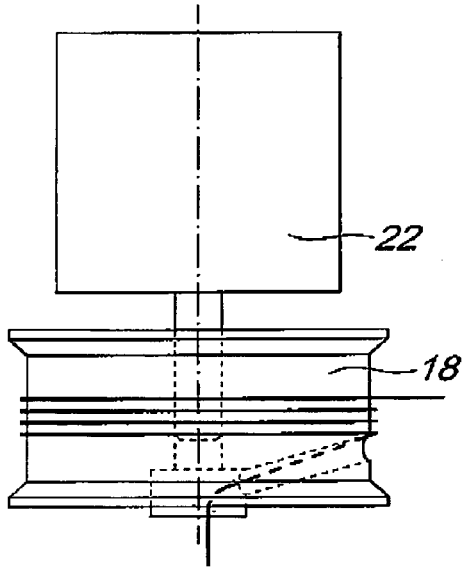
FIG. 5 is a view similar to FIG. 4, showing the device in operation.

In FIGS. 4, 5 an alternative configuration of yarn-recovering device 10 is shown, in which the axis of reel 18 is parallel to, and substantially coincides with, the incoming direction D' of the yarn, i.e., angle $\alpha$ is equal to zero.

Figure 6:
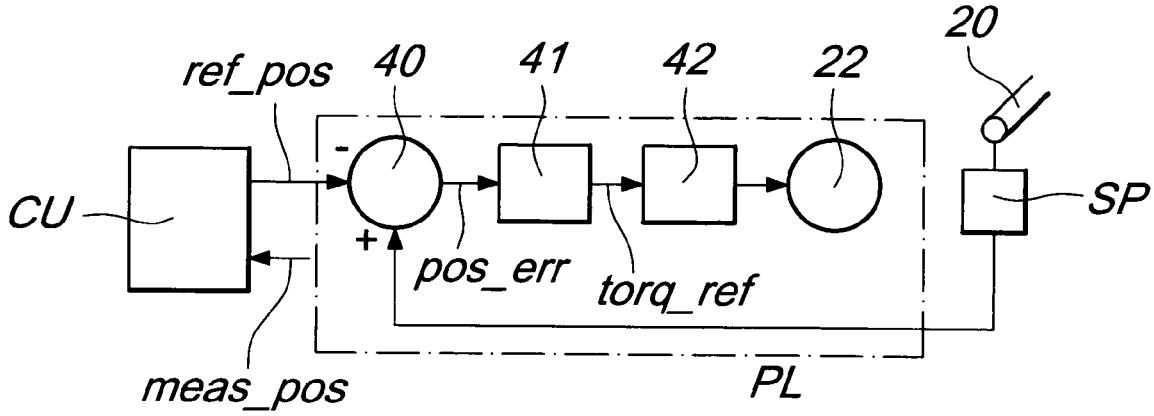
FIG. 6 is a block diagram of a control system for governing the yarn-recovering device according to the invention.
Figure 7:
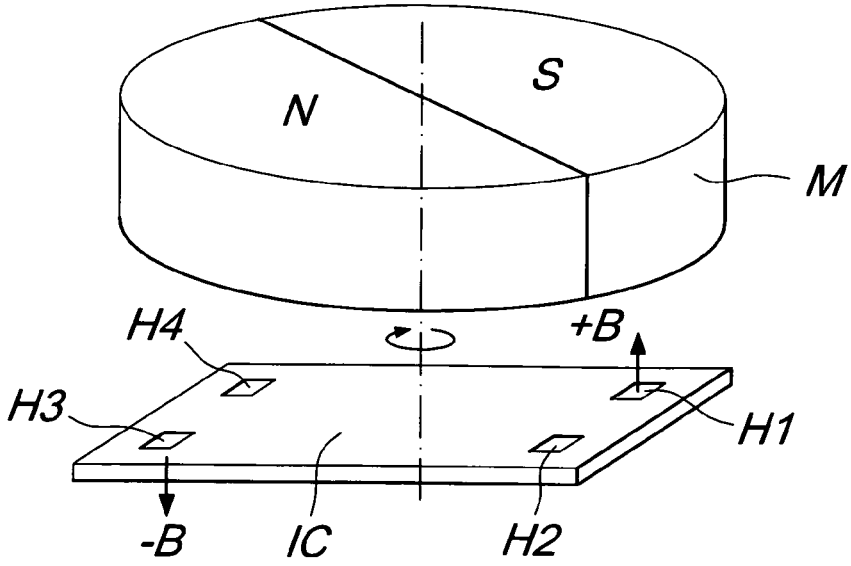
FIG. 7 is a diagrammatical perspective view showing a separate element of the control system of FIG. 6.

FIGS. 6, 7 show a position control system for governing the above described yarn-recovering device.

In FIG. 6, motor 22 is provided with a position sensor SP for measuring the position of driving shaft 20 and sending an absolute, measured position signal meas_pos to a position control loop PL. Control loop PL comprises a subtracter block 40 in which a position error Pos_err is calculated by subtracting measured position signal meas_pos from a reference position signal ref_pos. Position error pos_err is sent to a compensator block 41, such as a proportional integral compensator (PI) or a proportional integral derivative compensator (PID), which is programmed to generate a reference torque signal torq_ref such as to minimize the position error. Reference torque signal torq_ref is then sent to a current feedback loop 42 connected to control the current through motor 22 by feedback. A controller CU is programmed to vary reference position signal pos_ref on the basis of the operative state of the downstream machine. In particular, when the device is at rest in its resting position, i.e., while the yarn is processed by the downstream machine, controller CU generates a reference position signal corresponding to the resting position of FIG. 2. On the contrary, when it is required to recover yarn from the downstream machine, controller CU generates a reference position signal pos_ref such as to rotate reel 18 at the angle needed to recover the desired length of yarn. When the yarn must be returned to the downstream machine, controller CU generates the reference position signal again corresponding to the resting position. Reference position signal corresponding to the resting position may be either programmed in the factory or, preferably, a manual calibration procedure may be provided, in which the operator manually positions reel 18 at its non-interference position, in which inlet port 28*a* and outlet port 28*b* are aligned to direction D of incoming yarn F. Thereafter, by pushing a button associated to controller CU, such position is stored as resting position that will be called up at each start for aligning the yarn-recovering device.

FIG. 7 shows an absolute position sensor particularly suitable to the present application, because of its low costs and reduced sizes. A diametrically polarized, cylindrical permanent magnet M, preferably a rare earth magnet, such as samarium-cobalt or iron-boron, is coaxially anchored to one end of driving shaft 20 of motor 22. An integrated circuit IC is arranged near the magnet at right angles to the axis of shaft 20, and bears four Hall sensors, H1, H2, H3, H4 arranged to form a square, whereby the two pairs of opposite sensors H1, H3 and H2, H4 are alternately excited during the rotation of the magnet, with the sensors of each pair which are simultaneously excited in opposing directions, as shown by arrows −B, +B. Integrated circuit IC contains the circuitry (not shown) required for calculating the position of magnet M on the basis of the signals from the Hall sensors.

A few preferred embodiments of the invention have been described herein, but of course many changes may be made by the person skilled in the art within the scope of the inventive concept. In particular, although in the above-described example inlet port 28*a* of passage 28 is very close to the axis of rotation of reel 18, whereby the incoming yarn is not subjected to floatations and tension peaks during the rotation, however, with certain applications in which slight flotations can be tolerated the inlet port 28*a* can be located at a position farther from axis A. Moreover, passage 28, which connects the inlet port to the outlet port, could have different shapes and sizes. For example, in case of a hollow reel, the passage could simply consist of the cavity within the reel. Further, passage 28 could directly lead to the front surface of the reel, without need for any axial cavity 26.

The disclosures in Italian Patent Application No. TO2005A000469 from which this application claims priority are incorporated herein by reference.

What is claimed is:

1. A yarn-recovering device arrangeable upstream of a textile machine for temporarily recovering a length of yarn previously fed to the machine and for returning it subsequently, comprising a motorized reel having a substantially axial inlet port and an outlet port on a lateral surface thereof, with a passage for the yarn formed within the reel between said ports, said reel being operatable to rotate from a resting configuration, in which the reel is kept still, to an active, yarn-recovering configuration, in which the reel is driven in one direction for winding the yarn on itself and recovering it from the machine, to a subsequent active, yarn-unwinding configuration, in which it is driven in the opposite direction for unwinding the yarn from itself and returning it to the machine, wherein it is controlled by a position control system comprising a position sensor arranged to measure a position of the reel and to send a corresponding measured position signal to a position control loop, which compares said measured position signal with a reference position signal corresponding to a desired position for the motorized reel, and drives the reel in such a way as to minimize a difference between the measured position and the desired position.

2. The device of claim 1, in which said reel, in its operative position, is arranged with its axis of rotation inclined at a first angle to a direction of the incoming yarn, wherein said inlet port and outlet port are arranged such as to be substantially aligned to the direction of the incoming yarn, with the reel in said resting position.

3. The device of claim 1, wherein said passage consists of a rectilinear conduit inclined with respect to the axis of the reel.

4. The device of claim 2, wherein said passage consists of a rectilinear conduit inclined at a second angle with respect to the axis of the reel, which second angle is substantially equal to said first angle.

5. The device of claim 1, wherein said inlet port is formed in an axial cavity that is open to one longitudinal end of the reel for receiving the yarn.

6. The device of claim 5, wherein a yarn-guide eyelet is applied to a rim of the axial cavity for protecting the incoming yarn.

7. The device of claim 1, wherein said position sensor comprises a diametrically polarized, cylindrical permanent magnet that is coaxially anchored to the motorized reel, and four Hall sensors arranged in two opposite pairs to form a square around an axis of rotation of the motorized reel, whereby the two pairs of opposite sensors are alternately excited during the rotation of the magnet, with the sensors of each pair which are simultaneously excited in opposite directions.

8. The device of claim 1, wherein said position control loop comprises a subtracter block, which calculates a position error by subtracting said measured position signal from a reference position signal, and sends the position error to a compensator block programmed to generate a reference torque signal such as to minimize the position error, said reference torque signal being sent to a current feedback loop connected to feedback control the current supplied to the motorized reel.

9. The device of claim 1, wherein said reference position signal is generated by a controller on the basis of the operative state of said textile machine, in such a way that, while the yarn is processed, the controller generates a reference position signal corresponding to the resting position, while, when it is required to recover yarn, the controller generates a reference position signal such as to rotate reel of an angle required to recover a desired length of yarn.

10. A yarn-recovering device arrangeable upstream of a textile machine for temporarily recovering a length of yarn previously fed to the machine and for returning it subsequently, comprising a motorized reel having a substantially axial inlet port and an outlet port on a lateral surface thereof, with a passage for the yarn between said ports, said reel being operatable to rotate from a resting configuration, in which the reel is kept still, to an active, yarn-recovering configuration, in which the reel is driven in one direction for winding the yarn on itself and recovering it from the machine, to a subsequent active, yarn-unwinding configuration, in which it is driven in the opposite direction for unwinding the yarn from itself and returning it to the machine, wherein said reel, in its operative position, is arranged with its axis of rotation inclined at a first angle to a direction of the incoming yarn, wherein said inlet port and outlet port are arranged such as to be substantially aligned to the direction of the incoming yarn, with the reel in said resting position.

11. The device of claim 10, wherein said passage consists of a rectilinear conduit inclined with respect to the axis of the reel.

12. The device of claim 10, wherein said passage consists of a rectilinear conduit inclined at a second angle with respect to the axis of the reel, which second angle is substantially equal to said first angle.

13. The device of claim 10, wherein said inlet port is formed in an axial cavity that is open to one longitudinal end of the reel for receiving the yarn.

14. The device of claim 13, wherein a yarn-guide eyelet is applied to a rim of the axial cavity for protecting the incoming yarn.

15. The device of claim 10, wherein it is controlled by a position control system comprising a position sensor arranged to measure a position of the reel and to send a corresponding measured position signal to a position control loop, which compares said measured position signal with a reference position signal corresponding to a desired position for the motorized reel, and drives the reel in such a way as to minimize a difference between the measured position and the desired position.

16. The device of claim 15, wherein said position sensor comprises a diametrically polarized, cylindrical permanent magnet that is coaxially anchored to the motorized reel, and four Hall sensors arranged in two opposite pairs to form a square around an axis of rotation of the motorized reel, whereby the two pairs of opposite sensors are alternately excited during the rotation of the magnet, with the sensors of each pair which are simultaneously excited in opposite directions.

17. The device of claim 15, wherein said position control loop comprises a subtracter block, which calculates a position error by subtracting said measured position signal from a reference position signal, and sends the position error to a compensator block programmed to generate a reference torque signal such as to minimize the position error, said reference torque signal being sent to a current feedback loop connected to feedback control the current supplied to the motorized reel.

18. The device of claim 15, wherein said reference position signal is generated by a controller on the basis of the operative state of said textile machine, in such a way that, while the yarn is processed, the controller generates a reference position signal corresponding to the resting position, while, when it is required to recover yarn, the controller generates a reference position signal such as to rotate reel of an angle required to recover a desired length of yarn.

* * * * *